US006932700B2

(12) United States Patent
Bennett et al.

(10) Patent No.: US 6,932,700 B2
(45) Date of Patent: Aug. 23, 2005

(54) GAMING MACHINE WITH MULTI-DIMENSIONAL SYMBOLS

(75) Inventors: Nicholas Luke Bennett, Lane Cove (AU); Natalie Bryant, Lane Cove (AU)

(73) Assignee: Aristocrat Technologies Australia Pty Ltd., New South Wales (AU)

( * ) Notice: Subject to any disclaimer, the term of this patent is extended or adjusted under 35 U.S.C. 154(b) by 0 days.

(21) Appl. No.: 09/934,912

(22) Filed: Aug. 22, 2001

(65) Prior Publication Data

US 2004/0009803 A1 Jan. 15, 2004

(30) Foreign Application Priority Data

Aug. 22, 2000 (AU) ..... PQ9586

(51) Int. Cl.[7] ..... A63F 9/24
(52) U.S. Cl. ..... 463/20; 463/16
(58) Field of Search ..... 463/1, 12, 13, 463/16–20, 31; 273/146, 138.1, 142 A, 138 R

(56) References Cited

U.S. PATENT DOCUMENTS 5,344,145 A * 9/1994 Chadwick et al. ..... 463/31
6,120,377 A * 9/2000 McGinnis et al. ..... 463/20
6,123,333 A * 9/2000 McGinnis et al. ..... 273/146
6,213,876 B1 * 4/2001 Moore, Jr. ..... 463/22
6,305,686 B1 * 10/2001 Perrie et al. ..... 273/146

FOREIGN PATENT DOCUMENTS

GB 2 253 300 * 9/1992 ..... G07F/17/34

OTHER PUBLICATIONS

Examination Report, Patent Application No. 513431, Intellectual Property Office of New Zealand.
Examination Report, Patent Application No. 509300, Intellectual Property Office of New Zealand.

* cited by examiner

*Primary Examiner*—Michael O'Neill
(74) *Attorney, Agent, or Firm*—Katten Muchin Rosenman LLP

(57) ABSTRACT

A gaming machine 10 has a display 14 and a game controller arranged to control images displayed on the display 14 The game controller is arranged to play a game 16 wherein at least one random event is caused to be displayed on the display 14. If a predefined winning event occurs, the machine awards a prize. The display 14 displays a plurality of movable carriers 18. Each of at least certain of the carriers 18 carries a representation of at least one polyhedral element. Each polyhedral element has a plurality of faces which are visible at any one time with an indicium being carried on each face. Indicia on faces of the polyhedral elements which are visible at a rest condition of the carriers are taken into consideration in the determination of whether or not a winning event has occurred.

13 Claims, 6 Drawing Sheets

| POSITION | REEL 1 | | | REEL 2 | | | REEL 3 | | | REEL 4 | | | REEL 5 | | |
|---|---|---|---|---|---|---|---|---|---|---|---|---|---|---|---|
| 1 | A | K | Q | Q | 10 | 9 | J | A | K | Q | A | J | 10 | 9 | J |
| 2 | SYA | SYB | SYC | 10 | J | K | A | J | 10 | J | Q | K | 9 | 10 | Q |
| 3 | Q | A | K | J | Q | Q | K | Q | J | A | 10 | Q | SYA | SYB | SYC |
| 4 | J | Q | A | SYA | 10 | 9 | SYA | SYB | SYC | K | J | A | J | 9 | 10 |
| 5 | A | K | J | A | K | J | A | J | K | Q | K | J | A | J | 9 |
| 6 | K | J | Q | 10 | J | Q | J | A | 9 | J | SYC | Q | 10 | K | SYA |
| 7 | Q | A | 10 | Q | A | J | K | 9 | J | SYB | Q | SYC | 9 | SYA | K |
| 8 | 9 | K | A | J | SYB | SYC | Q | J | A | 9 | A | K | SYB | 10 | J |
| 9 | A | 9 | Q | K | Q | 9 | A | K | Q | Q | 10 | A | J | 9 | 10 |
| 10 | 10 | Q | K | 10 | J | Q | J | A | 10 | A | Q | 10 | 10 | A | 9 |
| 11 | K | A | 10 | Q | 10 | J | K | 10 | J | K | SYA | Q | 9 | 10 | A |
| 12 | J | K | A | J | K | SYC | A | J | 9 | Q | J | 9 | SYA | SYB | SYC |
| 13 | SYB | 10 | 9 | SYB | J | 9 | Q | A | K | J | K | 10 | 10 | J | 9 |
| 14 | Q | K | Q | 10 | Q | J | J | K | A | 10 | Q | J | 9 | 10 | J |
| 15 | 10 | Q | J | A | 10 | Q | K | Q | J | SYB | SYC | Q | K | 9 | 10 |
| 16 | A | SYC | K | K | J | A | A | J | Q | Q | A | K | SYC | K | SYB |
| 17 | 9 | A | Q | Q | SYC | 9 | 10 | A | K | A | 9 | 10 | 10 | SYC | 9 |
| 18 | K | 9 | A | J | A | K | J | K | A | K | Q | SYB | 9 | J | 10 |
| 19 | SYC | K | 9 | 10 | Q | J | A | J | 10 | J | K | Q | SYB | 10 | SYC |
| 20 | Q | 10 | K | A | J | Q | K | 9 | J | 10 | J | A | A | Q | 9 |

FIG. 3

GAMING MACHINE WITH MULTI-DIMENSIONAL SYMBOLS

FIELD OF THE INVENTION

This invention relates to a gaming machine. More particularly, the invention relates to a gaming machine and to an improvement to a game played on such a gaming machine.

BACKGROUND TO THE INVENTION

Players who regularly play gaming machines quickly tire of particular games and therefore it is necessary for manufacturers of these machines to develop innovative game features which add interest to the games. In so doing, it is hoped to keep players amused and therefore willing to continue playing the game as well as to attract new players.

Also, with the growth that has occurred in the gaming machine market, there is intense competition between manufacturers to supply various existing and new venues. When selecting a supplier of gaming machines, the operator of a venue will often pay close attention to the popularity of various games with their patrons. Therefore, gaming machine manufacturers are keen to devise games which are popular with the players as a mechanism for improving sales, retaining customers and attracting new customers.

SUMMARY OF THE INVENTION

According to the invention, there is provided a gaming machine having a display means and a game control means arranged to control images displayed on the display means, the game control means being arranged to play a game wherein at least one random event is caused to be displayed on the display means and, if a predefined winning event occurs, the machine awards a prize, the gaming machine being characterised in that the display means displays a plurality of movable carriers, each of at least certain of the carriers carrying a representation of at least one polyhedral element, each polyhedral element having a plurality of faces which are visible at any one time with an indicium being carried on each face and indicia on faces of the polyhedral elements which are visible at a rest condition of the carriers being taken into consideration in the determination of whether or not a winning event has occurred.

The display means may be a video display unit and the carriers may be video simulations of movable carriers with video simulations of the polyhedral elements thereon.

Each carrier may have more than one polyhedral element. The polyhedral elements may be spaced from each other on each carrier such that only one polyhedral element is visible at a time when the carrier is at rest.

In a preferred form of the invention the game is a spinning reel game. Hence, each carrier may be in the form of a spinning reel carrying at least one of the polyhedral elements thereon.

Each element may be fixed with respect to its associated carrier. In other words, the element may not move relative to its associated carrier. Instead, at least certain of the elements are movable with respect to their associated carriers. Then, when the reels come to rest, the elements may rotate relative to their reels before the elements, in turn, come to rest. Each of said at least certain of the elements may be rotatable about at least two axes, an axis parallel to a direction of movement of its associated carrier (a vertical axis) and an axis transverse to the direction of movement of its associated carrier (a horizontal axis).

Each element may be displayed in a three dimensional format so that at least two faces and, preferably, at least three faces are visible. For example, a front face, a side face and a top face may be visible. It will be appreciated that, with this configuration and where all reel strip positions have polyhedral elements, the effective length of a reel strip constituting each reel is effectively trebled.

The indicia carried on the faces of the elements may be standard symbols related to the game. In addition, or instead, the indicia carried on the faces of the elements may be special symbols in respect of the game such as substitute symbols, scatter symbols, bonus symbols trigger symbols, or the like.

Each polyhedral element may be substantially cubic in shape. It will, however, be appreciated that each polyhedral element could have more than six sides.

BRIEF DESCRIPTION OF THE DRAWINGS

The invention is now described by way of example with reference to the accompanying diagrammatic drawings in which:

FIG. 3 shows a table of reel strips constituting reels of a spinning reel game played on the machine of FIG. 1;

DETAILED DESCRIPTION OF THE DRAWINGS

Figure 1:
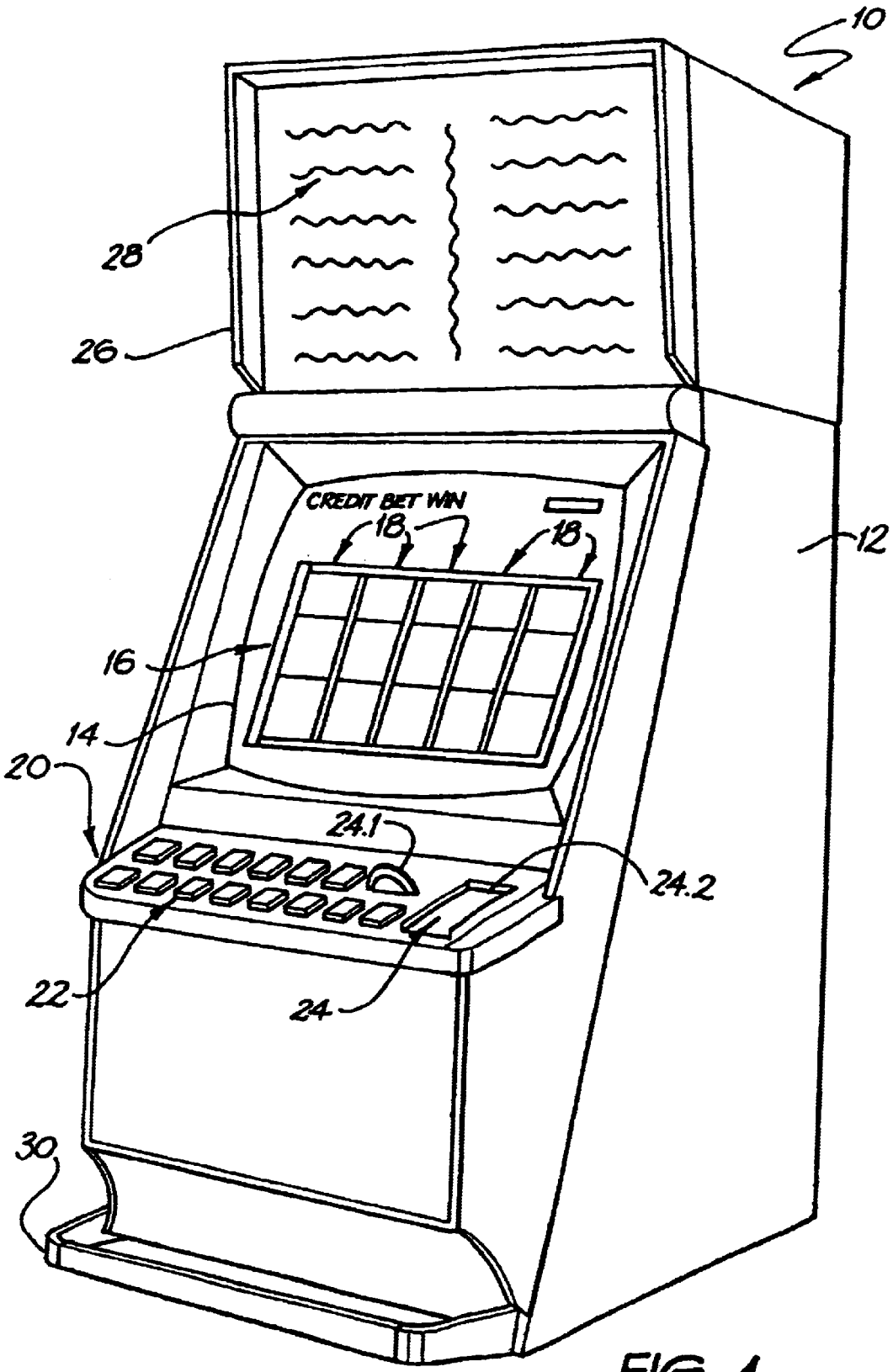
FIG. 1 shows a three dimensional view of a gaming machine, in accordance with the invention.

In FIG. 1, reference numeral 10 generally designates a gaming machine, including a game, in accordance with the invention. The machine 10 includes a console 12 having a video display unit 14 on which a game 16 is played, in use. The preferred form of a base game of the game 16 is a spinning reel game which simulates the rotation of a number of spinning reels 18. It will, however, be appreciated that the invention is equally applicable to other types of base games such as card games or ball games such as Keno, or the like. A midtrim 20 of the machine 10 houses a bank 22 of buttons for enabling a player to play the game 16. The midtrim 20 also houses a credit input mechanism 24 including a coin input chute 24.1 and a bill collector 24.2.

The machine 10 includes a top box 26 on which artwork 28 is carried. The artwork 28 includes paytables, details of bonus awards, etc.

A coin tray 30 is mounted beneath the console 12 for cash payouts from the machine 10.

Figure 2:
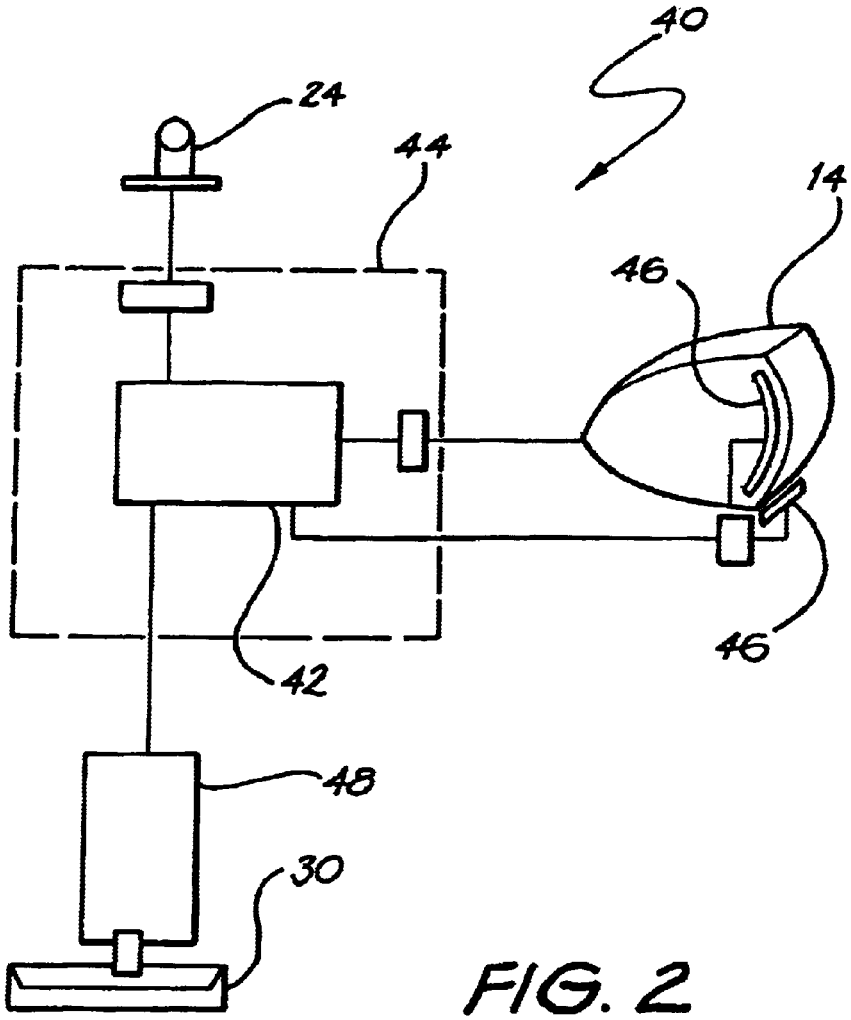
FIG. 2 shows a block diagram of a control circuit of the gaming machine.

Referring now to FIG. 2 of the drawings, a control means or control circuit 40 is illustrated. A program which implements the game and user interface is run on a processor 42 of the control circuit 40. The processor 42 forms part of a controller 44 which drives the screen of the video display unit 14 and which receives input signals from sensors 46. The sensors 46 include sensors associated with the bank 22 of buttons and touch sensors mounted in the screen 16. The controller 44 also receives input pulses from the mechanism 24 indicating that a player has provided sufficient credit to commence playing. The mechanism 24 may, instead of the coin input chute 24.1 or the bill collector 24.2, or in addition thereto, be a credit card reader (not shown) or any other type of validation device.

Finally, the controller 44 drives a payout mechanism 48 which, for example, may be a coin hopper for feeding coins to the coin tray 30 to make a pay out to a player when the player wishes to redeem his or her credit.

Figure 4:
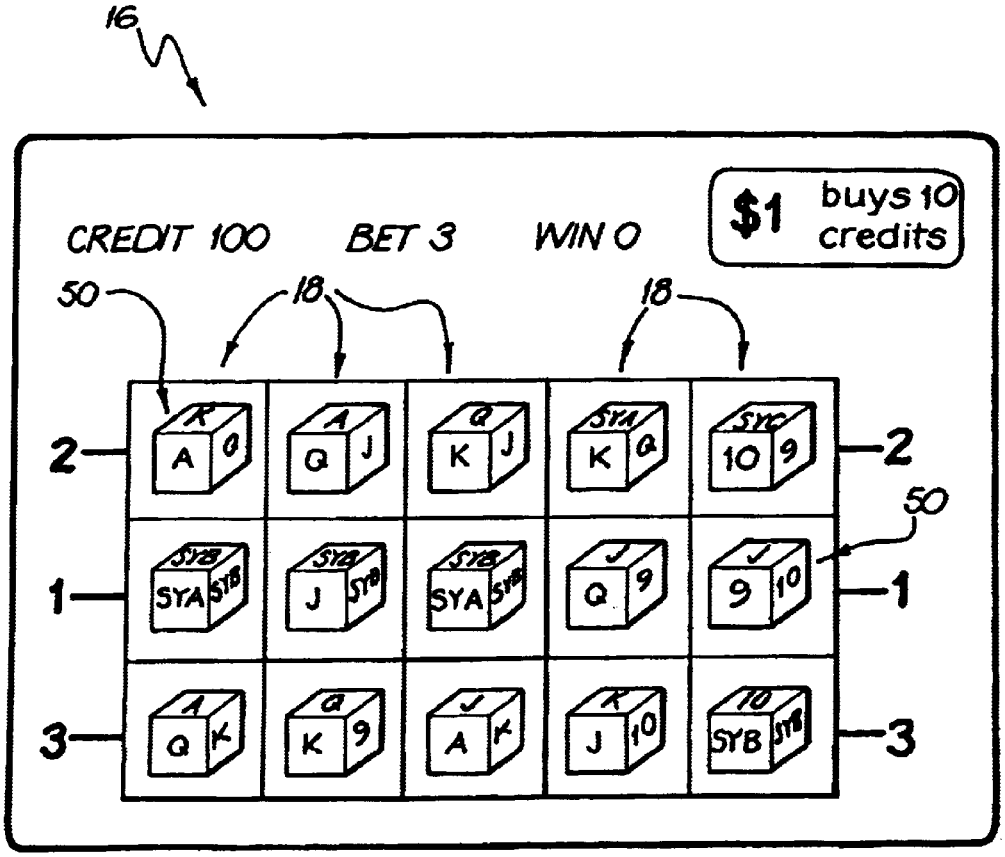
FIG. 4 shows a screen display of one embodiment of the game using predetermined reel stopping positions from the table of FIG. 3.

Referring now to FIGS. 3 and 4 of the drawings, a first embodiment of the invention is illustrated and described.

A game 16 played on the gaming machine 10 has, as described above, a simulation of a plurality of spinning reels 18. Each reel position on a reel strip which is mapped to an associated reel 18 is comprised of a polyhedral element 50 as shown in FIG. 4 of the drawings.

Each element 50 is a fixed representation on its associated reel 18. In other words, the elements 50 do not rotate or spin relative to their reels 18.

As a result, although each reel strip is, as illustrated in FIG. 3 of the drawings, only twenty positions in length, the effective length of each reel strip is trebled. This is achieved by showing each polyhedral element 50 so that multiple faces of the elements 50 are visible on the reel strips 18 as shown in FIG. 4 of the drawings. Accordingly, each position on the reel strip will represent at least three symbols in the case of a cubic element as shown and could conceivably represent more than three symbols rather than just one symbol as for the standard spinning game.

The screen display of the game 16 shown in FIG. 4 of the drawings assumes that the first reel stops at position two, the second reel stops at position eight, the third reel stops at position four, the fourth reel stops at position twelve and the fifth reel stops at position eighteen of the table of FIG. 3. Assuming that the game pays only for left-to-right combinations and for three or more of a kind of any of the symbols on any of the three indicated paylines the player will be paid for 3×SYB and 3×SYC on payline one, 4×Q on payline two and 4×K on payline three.

It is to be noted that, in assessing prize winning combinations, the symbols need not be on corresponding faces on the elements 50 on winning paylines. Hence, for example, considering the payment of 433 K on payline three, the first occurrence and third occurrence of K are on side faces of the elements 50, the second occurrence is on a front face and the fourth occurrence is on a top face of the elements 50.

In another version of this embodiment of the invention (not shown) each symbol 50 could, instead of the symbols described above, carry normal markings of a die thereon. Then, paylines passing through five of the symbols 50 are designated. The total applied to the sum of the resulting values of the five dice on a particular payline governs the prize awarded. The prize may be in accordance with the following table:

| Total | Prize/Credits |
|---|---|
| 30 | 10000 |
| 25 to 29 | 100 |
| 20 to 24 | 50 |
| 15 to 19 | 10 |
| 10 to 14 | 5 |
| 5 | 5000 |

In still other embodiments of the invention, each element 50 may carry a plurality of standard spinning reel game-type symbols and other patterns and multiplier numbers thereon. Thus, for example, if one of the elements 50 shows an Ace symbol and a second element, adjacent the first element 50, has a multiplier of five thereon then the prize which will be awarded is that for 5×Aces.

Figure 5:
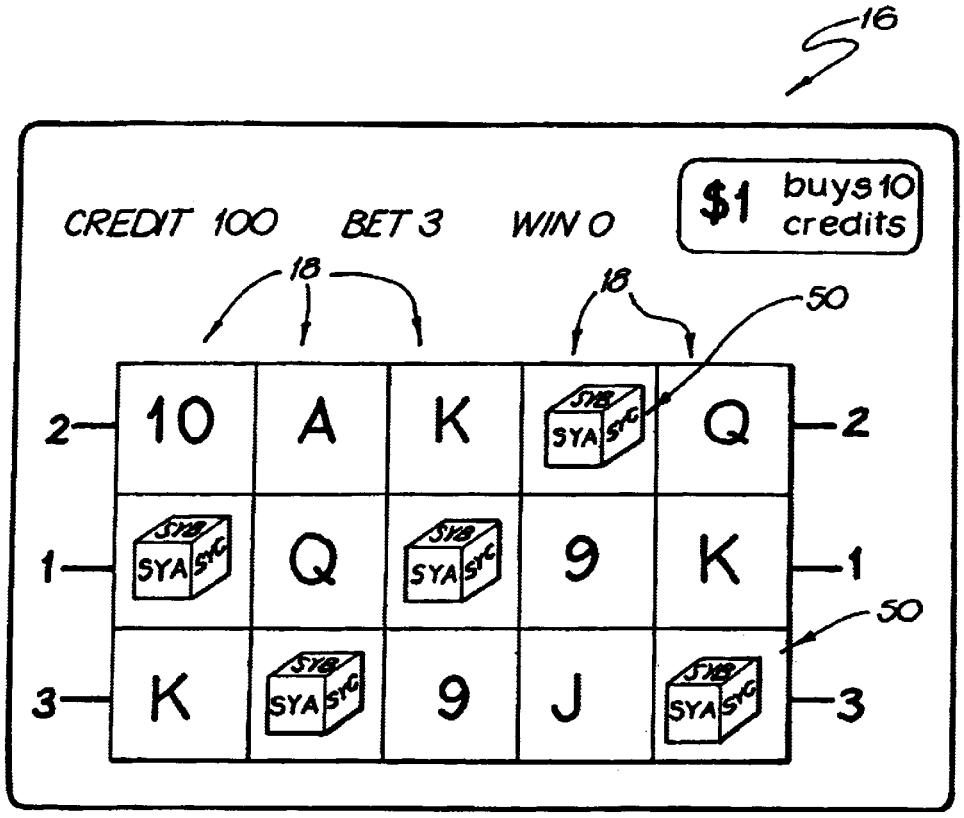
FIG. 5 shows a screen display of another embodiment of the game.
Figure 6:
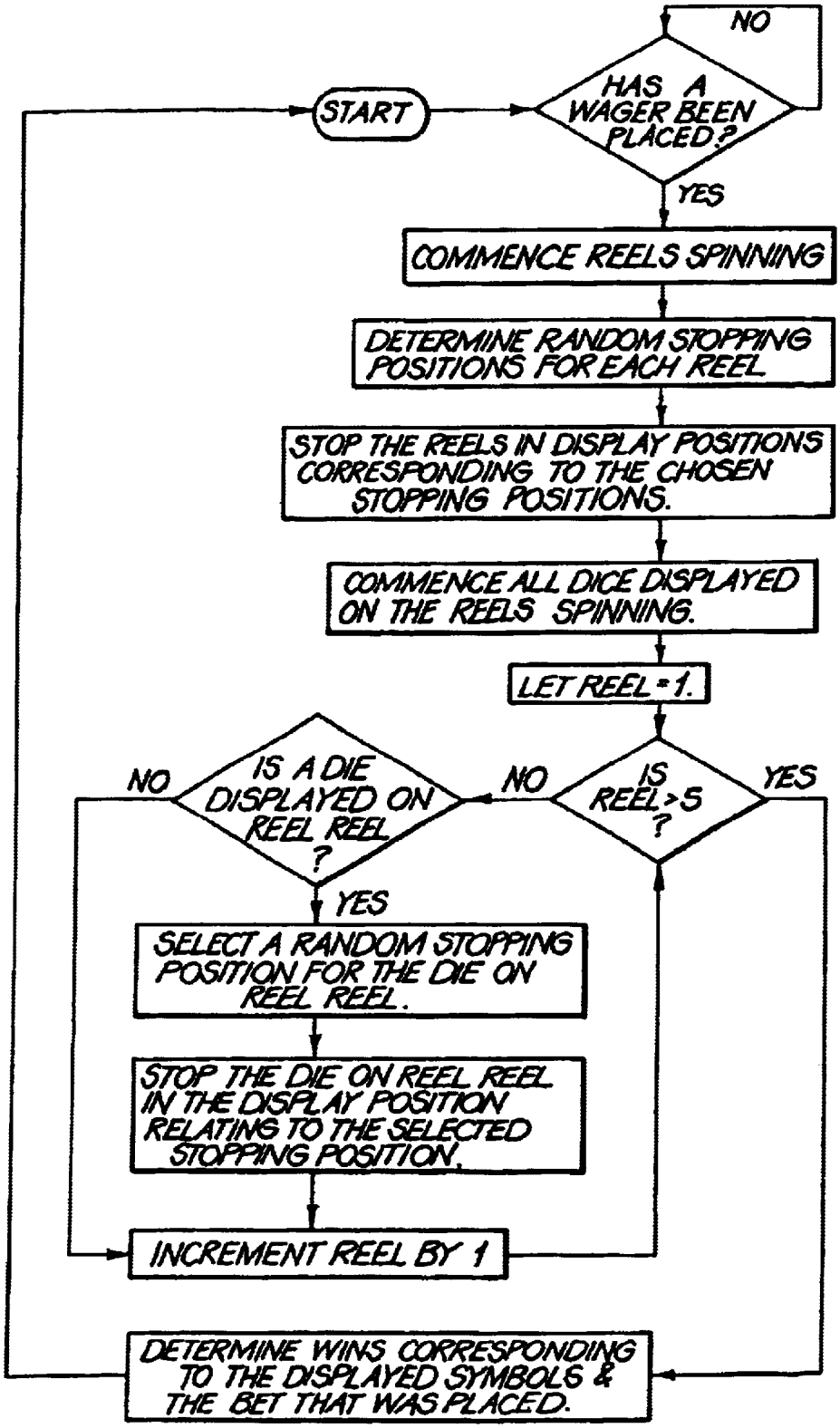
FIG. 6 shows a flow chart of the game of FIG. 5.

Referring now to FIGS. 5 and 6 of the drawings, a second embodiment of the invention is illustrated.

In this embodiment of the invention, not all reel strip positions have a polyhedral element. Only certain reel strip positions have the polyhedral elements 50. The elements 50 are spaced on each reel strip such that no two elements 50 are displayed simultaneously on any one reel 18 on the screen.

Further, unlike the embodiment described above with reference to FIGS. 3 and 4 of the drawings, the elements 50 are rotatable with respect to their carriers or reels 18. Accordingly, when the game 16 commences and the reels 18 are spun, once the reels 18 come to rest, the elements 50 which are displayed commence spinning and, at a later instance in time, come to rest. The elements 50 normally carry special symbols thereon which are picture symbols. These picture symbols function as scatter symbols, substitute symbols or top pay symbols.

In the example illustrated in FIG. 5 of the drawings, left-to-right pays only apply, prizes are paid for three or more of a kind and prizes are paid in respect of the three illustrated paylines. Assuming SYA is a substitute symbol, a prize is paid for 3×Q on payline one. If SYB is a scatter symbol, then a prize is paid for 5×SYB.

It is an advantage of the invention that a more versatile spinning reel game is provided than other types of spinning reel games of which the applicant is aware. Also, with the provision of carriers 18 and elements 50 which can rotate relative to the carriers 18, heightened tension will be provided thereby increasing player interest. Still further reel strips are effectively increased without increasing the actual length of the reel strips.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. A gaming machine having a display means and a game control means arranged to control images displayed on the display means, the game control means being arranged to play a game wherein at least one random event is caused to be displayed on the display means and, if a predefined winning event occurs, the machine awards a prize, wherein the display means displays a plurality on movable symbol carriers;

each of at least certain of the carriers carrying a two dimensional symbol which is a representation of a polyhedral element, each polyhedral element having a plurality of faces which are visble at any one time with an indicium being carried on each face; and indicia on at least two of the visible faces of each of the polyhedral elements which are visible at a rest condition of the carriers being taken into consideration in the determination of whether or not a winning event has occurred.

2. The gaming machine of claim 1 in which the display means is a video display unit; and the carriers are video simulations of movable carriers with video simulations of the polyhedral elements thereon.

3. The gaming machine of claim 1 in which each carrier has more than one polyhedral element.

4. The gaming machine of claim 3 in which the polyhedral elements are spaced from each other on each carrier such that only one polyhedral element is visible at a time when the carrier is at rest.

5. The gaming machine of claim 1 in which the game is a spinning reel game.

6. The gaming machine of claim 5 in which each carrier is in the form of a spinning reel carrying at least one of the polyhedral elements thereon.

7. The gaming machine of claim 1 in which each element is fixed with respect to its associated carrier.

8. The gaming machine of claim 1 in which at least certain of the elements are movable with respect to their associated carriers.

9. The gaming machine of claim 8 in which each of said at least certain of the elements is rotatable about at least two axes, an axis parallel to a direction of movement of its associated carrier and an axis transverse to the direction of movement of its associated carrier.

10. The gaming machine of claim 1 in which each element is displayed in a three dimensional format so that at least three faces are visible.

11. The gaming machine of claim 1 in which the indicia carried on the faces of the elements are standard symbols related to the game.

12. The gaming machine of claim 1 in which the indicia carried on the faces of the elements are special symbols in respect of the game.

13. The gaming machine of claim 1 in which each polyhedral element is substantially cubic in shape.

* * * * *